United States Patent [19]

Burri

[11] 4,238,130

[45] Dec. 9, 1980

[54] PRESSURE-SENSITIVE OR HEAT-SENSITIVE RECORDING MATERIAL

[75] Inventor: Peter Burri, Reinach, Switzerland

[73] Assignee: Ciba-Geigy Corporation, Ardsley, N.Y.

[21] Appl. No.: 911,564

[22] Filed: Jun. 1, 1978

[30] Foreign Application Priority Data

Jun. 10, 1977 [CH] Switzerland ..... 7180/77

[51] Int. Cl.[2] ..... B41M 5/16; B41M 5/18; B41M 5/22

[52] U.S. Cl. ..... 282/27.5; 106/21; 260/391; 427/150; 427/152; 428/307; 428/913; 428/914

[58] Field of Search ..... 106/21; 282/27.5; 427/150, 151, 152; 428/307, 411, 913, 914; 260/391

[56] References Cited

U.S. PATENT DOCUMENTS

| | | | |
|---|---|---|---|
| 3,418,128 | 12/1968 | Huett | 260/391 X |
| 3,493,376 | 2/1970 | Fichter | 96/90 |
| 3,775,442 | 11/1973 | Hughes | 260/391 |
| 3,995,088 | 11/1976 | Garner et al. | 282/27.5 |

*Primary Examiner*—Bruce H. Hess

*Attorney, Agent, or Firm*—Michael W. Glynn; Edward McC. Roberts

[57] ABSTRACT

A pressure-sensitive or heat-sensitive recording material which contains as color former in its color-forming system at least one substituted tris-aminophenylmethane compound of the general formula

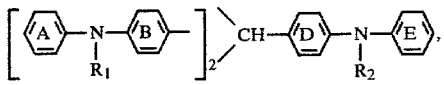

(1)

wherein $R_1$ and $R_2$, each independently of the other, represent hydrogen, lower alkyl, benzyl or phenyl, and the rings A,B,D and E, each independently of the other, are unsubstituted or substituted by halogen, nitro, trifluoromethyl, lower alkyl, lower alkoxy or lower alkoxycarbonyl.

10 Claims, No Drawings

PRESSURE-SENSITIVE OR HEAT-SENSITIVE RECORDING MATERIAL

The present invention relates to a pressure-sensitive or heat-sensitive recording material which contains as colour former in its colour-forming system at least one substituted tris-aminophenylmethane compound of the general formula

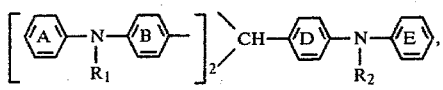

(1)

wherein $R_1$ and $R_2$, each independently of the other, represent hydrogen, lower alkyl, benzyl or phenyl, and the rings A, B, D and E, each independently of the other, are unsubstituted or substituted by halogen, nitro, carboxyl, trifluoromethyl, lower alkyl, lower alkoxy or lower alkoxycarbonyl.

In the definition of the radicals of the methane compounds, lower alkyl and lower alkoxy usually denote those groups or group components which contain 1 to 5, especially 1 to 3, carbon atoms, for example methyl, ethyl, n-propyl, isopropyl, n-butyl, sec-butyl or amyl, and methoxy, ethoxy or isopropoxy. Lower alkoxycarbonyl represents in particular carbomethoxy or carboethoxy. Halogen represents for example fluorine, bromine or preferably chlorine. $R_1$ and $R_2$, each independently of the other, preferably represent lower alkyl, especially methyl or ethyl, benzyl or phenyl.

The benzene rings A, B, D and E are preferably unsubstituted or, if they contain substituents, each independently of the other is substituted in particular by halogen, lower alkyl or lower alkoxy, for example by chlorine, methyl, methoxy or ethoxy. Each benzene ring can advantageously contain 1 to 2 substituents. The substituents of the rings A and E are preferably in the para-position to the nitrogen atom.

Colour former methane compounds of the formula (1) which are of practical importance have the general formula

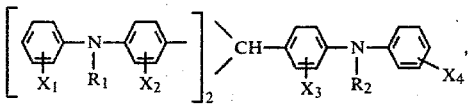

(2)

wherein $R_1$ and $R_2$ have the given meanings and $X_1$, $X_2$, $X_3$ and $X_4$, each independently of the other, represent hydrogen or lower alkoxy.

Colour formers having a particularly interesting utility are substituted methane compounds of the general formula

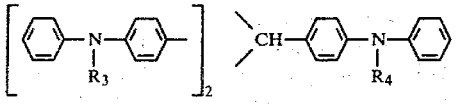

(3)

wherein $R_3$ and $R_4$, each independently of the other, represent methyl, ethyl, benzyl or phenyl.

Preferred compounds of the formula (3) above are in particular those in which $R_3$ represents methyl or benzyl and $R_4$ represents phenyl.

The substituted methane compounds of the formula (1) are prepared by reacting 1 mole of an aldehyde of the formula

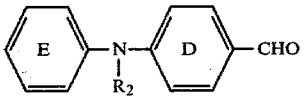

(4)

with 2 moles of a diphenylamine compound of the formula

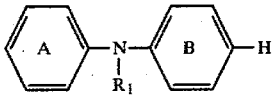

(5)

wherein A, B, D, E, $R_1$ and $R_2$ have the given meanings.

The aldehydes of the formula (4) can be obtained according to German Auslegeschrift No. 1,060,375, U.S. Pat. No. 2,558,285 or J. Org. Chem. Vol. 30, 3714–3718 (1965).

The condensation is advantageously carried out in an organic solvent, especially in halogenated hydrocarbons, for example ethylene chloride, carbon tetrachloride or chlorobenzenes; ethers, such as dioxane, diethyl ethers or tetrahydrofurane, tetramethylenesulphone (sulpholane), 3-methylsulpholane or dimethyl sulphoxide, and preferably in the presence of an acid catalyst or dehydrating agent. In some cases it is advantageous to use urea to shorten the reaction time and increase the yield.

Suitable acid condensation agents are for example hydrochloric acid, zinc chloride, aluminium chloride, polyphosphoric acid, thionyl chloride, phosphorus pentoxide, oleum, and especially phosphoroxy chloride or sulphuric acid having a concentration of preferably 70 to 98%.

The reaction can be carried out at a temperature of 20° to 100° C., preferably at 40° to 100° C. The reaction time depends on the temperature and is usually from ½ hour to 15 hours.

The isolation of the end product of the formula (1) is effected in a manner which is known per se, for example by pouring the reaction mixture into ice-water, if appropriate while neutralising the acids with an alkaline compound, for example ammonia, an alkali metal hydroxide or an alkali metal carbonate, collecting the resulting precipitate by filtration or removing the water-insoluble solvent by evaporation, and by washing and drying the product, and also by chromatographing or recrystallising the product, which in certain cases can contain insignificant amounts of polycondensation products.

The substituted methane compounds of the formula (1) to (3) are normally colourless or faintly coloured. When these colour formers are brought into contact with an acid developer, i.e. an electron acceptor, they produce intense violet, blue and green shades of excellent lightfastness. They are therefore also very useful when mixed with other known colour formers, for example 3,3-(bis-aminophenyl)-phthalides, 3,3-(bis-indolyl)-phthalides, 2,6-diaminofluoranes or spiropyranes, in order to give blue, navy blue, grey or black colourations.

The methane compounds of the formulae (1) to (3) exhibit both on clay and on phenolic substrates an improved colour intensity and lightfastness. They are suitable in particular as slowly developing colour formers for use in a pressure-sensitive recording material, which can also be a copying material.

A pressure-sensitive material consists for example of at least one pair of sheets, which contain at least one colour former of the formulae (1) to (3) dissolved in an organic solvent, and a solid electron acceptor as developer. The colour former effects a coloured marking at those points where it comes into contact with the electron acceptor.

Typical examples of such developers are attapulgite clay, silton clay, silica, bentonite, halloysite, aluminium oxide, aluminium sulphate, aluminium phosphate, zinc chloride, kaolin or any clay or organic compound with acid reaction, for example unsubstituted or ring-substituted phenols, salicylic acid or esters of salicylic acid and the metal salts thereof, or an acid polymeric material, for example a phenolic polymer, an alkylphenolacetylene resin, a maleic acid/rosin resin or a partially or completely hydrolysed polymer of maleic acid and styrene, ethylene, vinyl methyl ether or carboxypolymethylene. Preferred developers are attapulgite clay, silton clay, zinc salicylates or phenolformaldehyde resins. These electron acceptors are preferably applied in the form of a layer to the face of the receiver sheet.

In order to prevent the colour formers contained in the pressure-sensitive recording material from becoming active too soon, they are usually separated from the electron acceptor. This can advantageously be accomplished by incorporating the colour formers in foamlike, sponge-like or honeycomb-like structures. Preferably, however, the colour formers are enclosed in microcapsules, which can usually ruptured by pressure.

When the capsules are ruptured by pressure, for example with a pencil, and the colour former solution is transferred in this manner to an adjacent sheet which is coated with an electron acceptor, a coloured area is produced. This colour results from the dye which is formed and which is absorbed in the visible range of the electronmagnetic spectrum.

The colour formers are encapsulated preferably in the form of solutions in organic solvents. Examples of suitable solvents are preferably non-volatile solvents, for example polyhalogenated diphenyl, such as trichlorophenyl or a mixture thereof with liquid paraffin; tricresyl phosphate, di-n-butyl phthalate, dioctyl phthalate, trichlorobenzene, nitrobenzene, trichloroethyl phosphate, petroleum ether, hydrocarbon oils, such as paraffin, alkylated derivatives of naphthalene or diphenyl, terphenyls, partially hydrogenated terphenyl, or other chlorinated or hydrogenated condensed aromatic hydrocarbons.

The capsule walls can be formed evenly around the droplets of the colour former solution by coacervation forces, whilst the encapsulating material can consist of gelatin and gum arabic, as described e.g. in U.S. Pat. No. 2,800,457. The capsules can be formed preferably also from an aminoplast or from modified aminoplasts by polycondensation, as described in British Pat. Nos. 989,264, 1,156,725, 1,301,052 and 1,355,124.

The microcapsules containing the colour formers of formula (1) can be used for the manufacture of a wide variety of known kinds of pressure-sensitive copying material. The various systems differ substantially from one another in the arrangement of the capsules, the colour reactants and the carrier material.

A preferred arrangement is that in which the encapsulated colour former is applied as a layer to the back of a transfer sheet and the electron acceptor as a layer to the face of a receiving sheet. However the components can also be used in the paper pulp.

Another arrangement of the constituents consists in the microcapsules which contain the colour former, and the developer, being in or on the same sheet, in the form of one or more individual layers or being present in the paper pulp.

Such pressure-sensitive copying materials are described, for example, in U.S. Pat. Nos. 2,730,457, 2,932,582, 3,418,250, 3,427,180 and 3,516,846. Further systems are described in British Pat. Nos. 1,042,596, 1,042,597, 1,042,598, 1,042,599 and 1,053,935. Microcapsules which contain the colour formers of formula (1) are suitable for each of these systems and for other pressure-sensitive systems.

The capsules are preferably secured to the carrier by means of a suitable adhesive. Since paper is the preferred carrier material, these adhesives are principally paper coating agents, for example gum arabic, polyvinyl alcohol, hydroxymethyl cellulose, casein, methyl cellulose or dextrin.

As paper, there are used not only normal papers made from cellulose fibres, but also papers in which the cellulose fibres are replaced (partially or completely) by synthetic polymer fibres.

The methane compounds of the formulae (1) to (3) can also be used as colour formers in a thermo-reactive recording material. This recording material contains normally at least one carrier, one colour former, one solid electron acceptor and optionally also at least one binder. Thermoreactive recording systems comprise for example heat sensitive recording and copying materials and papers. These systems are used, for example, for recording information, e.g. in electronic computers, teleprinters or telewriters, and in measuring instruments. The image (mark) formation can also be effected manually with a heated pen. Laser beams can also be used to produce heat-induced marks.

The thermo-reactive recording material can be so composed that the colour former is dispersed or dissolved in one binder layer and the developer is dissolved or dispersed in the binder in a second layer. A second possibility consists in dispersing both the colour former and the developer in the binder in one layer. By means of heat the binder is softened at specific areas and the colour former comes into contact with the electron acceptor substance at those points where heat is applied and the desired colour develops at once.

Suitable developers are the same electron acceptors as are used in pressure-sensitive papers.

Examples of developers are the clays and phenolic resins already mentioned, or phenolic compounds, for example 4-tert-butylphenol, 4-phenylphenol, 4-hydroxydiphenyl oxide, α-naphthol, β-naphthol, 4-hydroxymethyl benzoate, 4-hydroxyacetophenone, 2,2'-dihydroxydiphenyl, 4,4-isopropylidenediphenol, 4,4'-isopropylidene-bis-(2-methylphenyl), 4,4'-bis-(hydroxyphenyl)valeric acid, hydroquinone, pyrogallol, chloroglucinol, as well as solid organic acids such as p-, m- and o-hydroxybenzoic acid, gallic acid, 1-hydroxy-2-naphthoic acid, as well as boric acid and aliphatic dicarboxylic acids, for example tartaric acid, oxalic acid, maleic acid, citric acid, citraconic acid or succinic acid.

Fusible, film-forming binders are preferably used for the manufacture of the thermoreactive recording material. These binders are normally water-soluble, whereas the methane compound and the developer are insoluble in water. The binder should be able to disperse and fix the colour former and the developer at room temperature. By applying heat the binder softens or melts, so that the colour former comes in contact with the developer and a colour is able to form. Examples of binders which are soluble or at least swellable in water are hydrophilic polymers, for example polyvinyl alcohol, polyacrylic acid, hydroxyethyl cellulose, methyl cellulose, carboxymethyl cellulose, polyacrylamide, polyvinyl pyrrolidone, gelatin and starch.

If the colour former and the developer are in two separate layers, it is possible to use water-insoluble binders, i.e. binders which are soluble in non-polar or only weakly polar solvents, for example natural rubber, synthetic rubber, chlorinated rubber, alkyd resins, polystyrene, styrene/butadiene copolymers, polymethylmethacrylates, ethyl cellulose, nitrocellulose and polyvinyl carbazole. A preferred arrangement, however, is one in which the colour former and the developer are contained in one layer in a water-soluble binder.

The thermoreactive coatings can contain further additives. To improve the degree of whiteness, to facilitate the printing of papers, and to prevent the heated pen from sticking, the coatings can contain, for example, talc, $TiO_2$, ZnO or $CaCO_3$ or also organic pigments, for example urea/formaldehyde polymers. In order to effect the colour formation only within a limited temperature range, it is possible to add substances such as urea, thiourea, acetanilide, phthalic anhydride or other appropriate fusible products which induce the simultaneous melting of the colour former and developer.

In the following Manufacturing Directions and Examples, the percentages are by weight unless otherwise indicated.

MANUFACTURING DIRECTIONS

A. 21.1 g of N-methyl-diphenylamine-4-aldehyde and 40.2 g of diphenylamine are dissolved in 150 ml of ethylene chloride and the solution is cooled to 0° C. With stirring and under nitrogen, 33.6 g of phosphoroxy chloride are added dropwise at 0° to 5° C. The reaction mixture is then heated in the course of half an hour to 50° C. and kept for 2 hours at this temperature. The ethylene chloride solution is poured into 5 times its volume of water and neutralised with a 30% ammonia solution. After standing for 2 hours, the organic phase is separated and washed once with water.

The ethylene chloride solution is then slowly added dropwise to 1.5 liters of methanol, whereupon the product precipitates in crystalline form. The precipitate is collected by filtration and dried, affording 27.8 g of a colourless compound of the formula

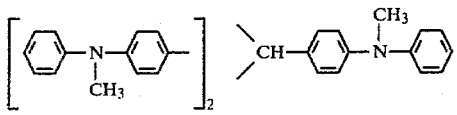

(11)

with a melting point of 82°–85° C.

On silton clay this colour former slowly develops an intensive lightfast blue colour with λ max at 605 nm.

B. 5.5 g of triphenylamine-4-aldehyde, 7.3 g of N-methyldiphenylamine and 0.7 g of urea are dissolved in 35 ml of sulpholane. Then 3.9 g of 98% sulphuric acid are added to the solution, such that the temperature does not rise above 40° C. The reaction solution is then stirred for 2½ hours at 40° C., subsequently added dropwise to 350 ml of methanol and neutralised with 30% ammonia. The product precipitates in crystalline form and is collected by filtration, washed with water and dried, affording 9.7 g of a colourless compound of the formula

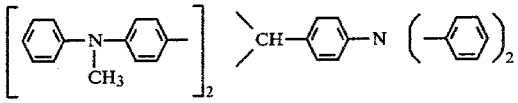

(12)

with a melting point of 110°–112° C.

On silton clay this colour former slowly develops an intense lightfast greenish blue colour with λ max at 625 nm.

C. 5.8 g of N-benzyl-diphenylamine-4-aldehyde and 7.3 g of N-methyldiphenylamine are dissolved in 30 ml of ethylene chloride. With stirring and under nitrogen, 6.1 g of phosphoroxy chloride are then added dropwise, such that the temperature remains between 15° and 20° C.

The solution is heated for 1 hour to 65°–70° C. and kept for 5 hours at this temperature. After cooling, the solution is poured into 200 ml of water and neutralised with 40% sodium hydroxide solution.

The ethylene chloride phase is separated, diluted with 50 ml of acetone and added dropwise to 500 ml of methanol, whereupon the product precipitates. The white precipitate is collected by filtration and dried in vacuo at 40°–50° C., affording 7.8 g of a compound of the formula

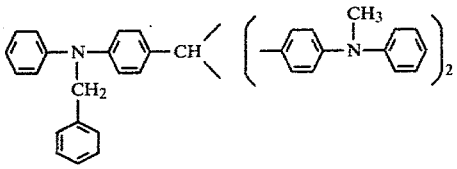

(13)

with a melting point of 83°–86° C.

On silton clay this colour former slowly develops an intense blue colour with λ max at 610 nm.

D. 5.8 g of N-benzyl-diphenylamine-4-aldehyde and 10.4 g of N-benzyldiphenylamine are dissolved in 35 ml of ethylene N-benzyldiphenylamine are dissolved in 35 ml of ethylene chloride. With stirring and under nitrogen, 6.1 g of phosphoroxy chloride are added dropwise to the solution. The mixture is then reacted as indicated in Manufacturing Direction C and the reaction product is isolated as described therein, affording 10.4 g of a colourless compound of the formula

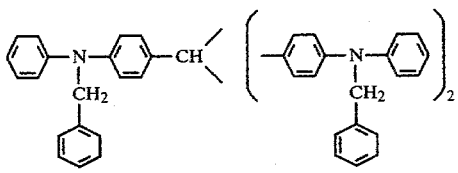

(14)

with a melting point of 86°–89° C.

On silton clay this colour former slowly develops an intense blue colour with λ max at 615 nm.

E. 6.4 g of 4-methoxy-N-methyl-diphenylamine are dissolved in 4.6 ml of dimethyl formamide and 10 ml of ethylene chloride. With stirring and cooling, 6.9 g of phosphoroxy chloride are added dropwise to the solution, such that the temperature does not rise above 20° C. The reaction mixture is subsequently stirred for 4 hours at room temperature. Then 3.2 ml of water are added and the temperature rises to 50° C. While introducing nitrogen, a solution of 12.8 g of 4-methoxy-N-methyl-diphenylamine in 10 ml of ethylene chloride are added and the mixture is stirred for 15 hours at 65° C. The condensation is brought to completion by adding dropwise 3 ml of concentrated hydrochloric acid and stirring the mixture for a further 3 hours.

The mixture is then poured into 200 ml of water and neutralised with 40% sodium hydroxide solution, whereupon the organic phase is separated and concentrated. The residue is dissolved in 50 ml of acetone and the solution is added dropwise to 300 ml of methanol. The precipitated product is separated and dissolved once more in 30 ml of acetone. The solution is again added dropwise to 200 ml of methanol and the precipitated product is collected by filtration and dired at 40° C. in vacuo, affording 3.2 g of a crystalline colourless compound of the formula

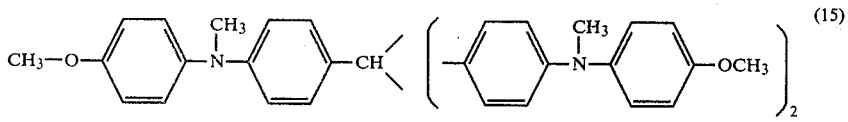

(15)

with a melting point of 64°–65° C.

On silton clay this colour former slowly develops an intense, lightfast blue colour with λ max at 612 nm.

F. 7.8 g of N-benzyl-diphenylamine are dissolved in 4.6 ml of dimethyl formamide and 15 ml of acetylene chloride. While cooling with ice-water, 6.9 g of phosphoroxy chloride are added dropwise to the solution, such that the temperature may not exceed 20° C. After stirring for 2 hours at room temperature, 3.2 ml of water and 3 ml of concentrated hydrochloric acid are slowly added. Nitrogen is then introduced, followed by the addition of a solution of 12.8 g of 4-methoxy-N-methyl-diphenylamine in 10 ml of ethylene chloride.

The condensation is complete after 8½ hours. The procedure described in Manufacturing Direction E is carried out, affording 4.2 g of a colourless crystalline compound of the formula

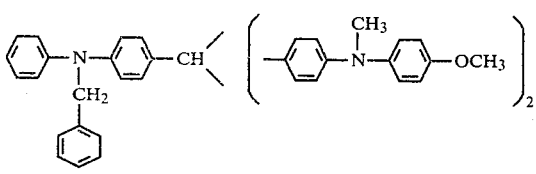

(16)

with a melting point of 70°–72° C.

On silton clay this colour former slowly develops an intense, lightfast blue colour with λ max. at 600 nm.

G. 5.8 g of N-methyl-diphenylamine-4-aldehyde and 8.2 g of N-ethyldiphenylamine are dissolved in 25 ml of ethylene chloride. With stirring and while introducing nitrogen, 7.7 g of phosphoroxy chloride are added to the solution and the mixture is heated for 2 hours to 60° C. The reaction product is then poured into 200 ml of water. After neutralisation with 40% sodium hydroxide solution, the organic phase is separated. The ethylene chloride solution is diluted with 20 ml of acetone and added dropwise to 300 ml of methanol, whereupon the product precipitates in crystalline form. The precipitate is collected by filtration and dried, affording 7 g of a colourless compound of the formula

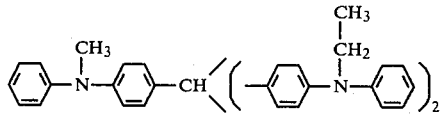

(17)

On silton clay this colour former slowly develops an intense, lightfast blue colour with λ max. at 609 nm.

EXAMPLE 1

Manufacture of a pressure-sensitive copying paper

A solution of 3 g of the methane compound of formula (11) in 97 g of partially hydrogenated terphenyl is emulsified in a solution of 12 g of pigskin gelatin in 88 g of water of 50° C. A solution of 12 g of gum arabic in 88 g of 50° C. is then added, followed by the addition of 200 ml of water of 50° C. The resultant emulsion is poured into 600 g of ice-water and cooled, whereupon the coacervation is effected. A sheet of paper is coated with the resultant suspension of microcapsules and dried. A second sheet of paper is coated with silton clay. The first sheet and the sheet of paper coated with silton clay are laid on top of each other with the coated sides face to face. Pressure is exerted on the first sheet by writing by hand or with a typewriter and an intense blue copy of excellent lightfastness slowly develops on the sheet coated with silton clay.

An intense, lightfast greenish blue copy can be obtained by using the colour formers of the formulae (12) to (17) instead of the methane compound of the formula (11).

EXAMPLE 2

Manufacture of a thermoreactive paper 6 g of an aqueous dispersion which contains 1.57% of the methane compound of the formula (11) and 6.7% of polyvinyl alcohol are mixed with 134 g of an aqueous dispersion which contains 14% of 4,4-isopropylidene-diphenol, 8% of attapulgite clay and 6% of polyvinyl alcohol. This mixture is applied to a paper and dried. Contacting the paper with a heated ball-point pen produces an intense bluish green colour of excellent lightfastness.

Intense and lightfast blue or green colours can also be obtained by using each of the other colour formers of the formulae (12) to (17).

I claim:

1. A pressure-sensitive or heat-sensitive recording material which contains as colour former in its colour-forming system at least one tris-aminophenylmethane compound of the formula

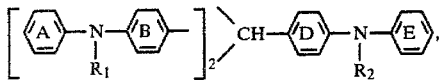

(1)

wherein $R_1$ and $R_2$, each independently of the other, represent hydrogen, lower alkyl, benzyl or phenyl, and the rings A, B, D and E, each independently of the other, are unsubstituted or substituted by one or two substituents selected from the group consisting of halogen, nitro, trifluoromethyl, lower alkyl, lower alkoxy and lower alkoxycarbonyl.

2. A recording material according to claim 1, wherein the methane compound has the formula

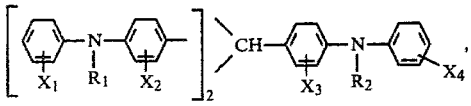

(2)

wherein $R_1$ and $R_2$ are as defined in claim 1 and $X_1$, $X_2$, $X_3$ and $X_4$, each independently of the other, represent hydrogen or lower alkoxy.

3. A recording material according to claim 2, wherein $X_1$, $X_2$, $X_3$ and $X_4$ represent hydrogen and $R_1$ and $R_2$, each independently of the other represent methyl, ethyl, benzyl or phenyl.

4. A recording material according to claim 3 wherein $R_1$ and $R_2$ are methyl.

5. A recording material according to claim 1 which is pressure-sensitive.

6. A pressure-sensitive recording material according to claim 5 which contains the methane compound, dissolved in an organic solvent, and at least one solid electron acceptor.

7. A pressure-sensitive recording material according to claim 5, wherein the methane compound is encapsulated in microcapsules.

8. A pressure-sensitive recording material according to claim 7, wherein the encapsulated methane compound is present in the form of a layer on the back of a transfer sheet and the electron acceptor is present in the form of a layer on the face of a receiving sheet.

9. A pressure-sensitive recording material according to claim 5, which contains the methane compound together with one or more other colour formers.

10. A heat-sensitive recording material according to claim 1 which contains in at least one layer at least one colour former, at least one electron acceptor and, optionally, at least one binder, wherein the colour former has the formula of claim 1.

* * * * *